United States Patent [19]

Mitchell et al.

[11] Patent Number: 4,679,253

[45] Date of Patent: Jul. 14, 1987

[54] SHOULDER PAD TRUSS ARCH SYSTEM

[75] Inventors: Hal D. Mitchell; Donald R. Walker, both of Rolla, Mo.

[73] Assignee: Figgie International Inc., Willoughby, Ohio

[21] Appl. No.: 897,082

[22] Filed: Aug. 18, 1986

[51] Int. Cl.[4] ..... A41D 13/00

[52] U.S. Cl. ..... 2/2; 2/45

[58] Field of Search ..... 2/2, 45, 416

[56] References Cited

U.S. PATENT DOCUMENTS

| | | | |
|---|---|---|---|
| 1,709,184 | 4/1929 | Mullins | 2/2 |
| 2,247,961 | 7/1941 | Mulvey | 2/2 |
| 2,250,275 | 7/1941 | Riddell | 2/2 X |
| 3,237,201 | 3/1966 | Morgan | 2/416 X |
| 4,407,021 | 10/1983 | Kralik et al. | 2/416 |

*Primary Examiner*—Louis K. Rimrodt

*Attorney, Agent, or Firm*—Senniger, Powers, Leavitt and Roedel

[57] ABSTRACT

A shoulder pad truss arch system for a shoulder pad. The shoulder pad has a generally inverted U-shape arch member adapted to fit over a shoulder of a wearer, and the arch member has chestplate and backplate portions interconnected by a curved shoulder portion. The shoulder pad truss arch system comprises a first truss extending from the chestplate portion of the arch member to the shoulder portion of the arch member, a second truss extending from the backplate portion of the arch member to the shoulder portion of the arch member, and a truss bridge. One end of the truss bridge is attached to the first truss, and the other end of the truss bridge is attached to the second truss so as to suspend the truss system and thus the shoulder pad on the shoulder of the wearer such that impact on the shoulder portion of the arch member causes the chestplate and backplate portions to be pulled toward one another.

14 Claims, 5 Drawing Figures

SHOULDER PAD TRUSS ARCH SYSTEM

BACKGROUND OF THE INVENTION

This invention relates generally to shoulder pads for football players and the like, and more particularly to a shoulder pad truss arch system which spreads impact loads over the shoulders of a football player.

Shoulder pads are generally designed to reduce and spread impact loads from colliding football players over the shoulders of the wearer. Heretofore, shoulder pad designs have included thick inner padding sections, inverted V-shaped flexible straps located between the inner padding sections and the hard outer layer of the shoulder pad, and various combinations of epaulets and web hinges. In particular, the hard outer layer and the inner padding section in combination have served to absorb the load. When impacted, conventional shoulder pads tend to transmit the load to the shoulder only in the immediate area of impact and do not spread the load over other areas of the shoulders, chest and back. However, a shoulder pad should spread the load over a large area of the shoulders, chest and back, since the greater the area over which the load is spread, the greater the load that can be absorbed.

SUMMARY OF THE INVENTION

Among the several objects of the invention may be noted the provision of a shoulder pad truss arch system, particularly adapted to spread the impact load over a larger area of the shoulders of a player; and the provision of such a truss arch system that is inexpensive and durable.

Generally, a truss arch system of this invention is adapted for a shoulder pad for football players and the like. The shoulder pad has a generally inverted U-shape arch member adapted to fit over a shoulder of a wearer, and the arch member has chestplate and backplate portions interconnected by a curved shoulder portion. The shoulder pad truss arch system comprises a first truss extending up from the chestplate portion of the arch member to the shoulder portion of the arch member, a second truss extending up from the backplate portion of the arch member to the shoulder portion of the arch member, and a truss bridge extending between the first and second trusses at a location spaced below the shoulder portion of the arch member. One end of the truss bridge is attached to the first truss, and the other end of the truss bridge is attached to the second truss so as to suspend the truss system and thus the shoulder pad on the shoulder of the wearer such that impact on the shoulder portion of the arch member causes the shoulder of the wearer to force at least a portion of the truss arch system generally upwardly to pull the chestplate and backplate portions toward one another.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
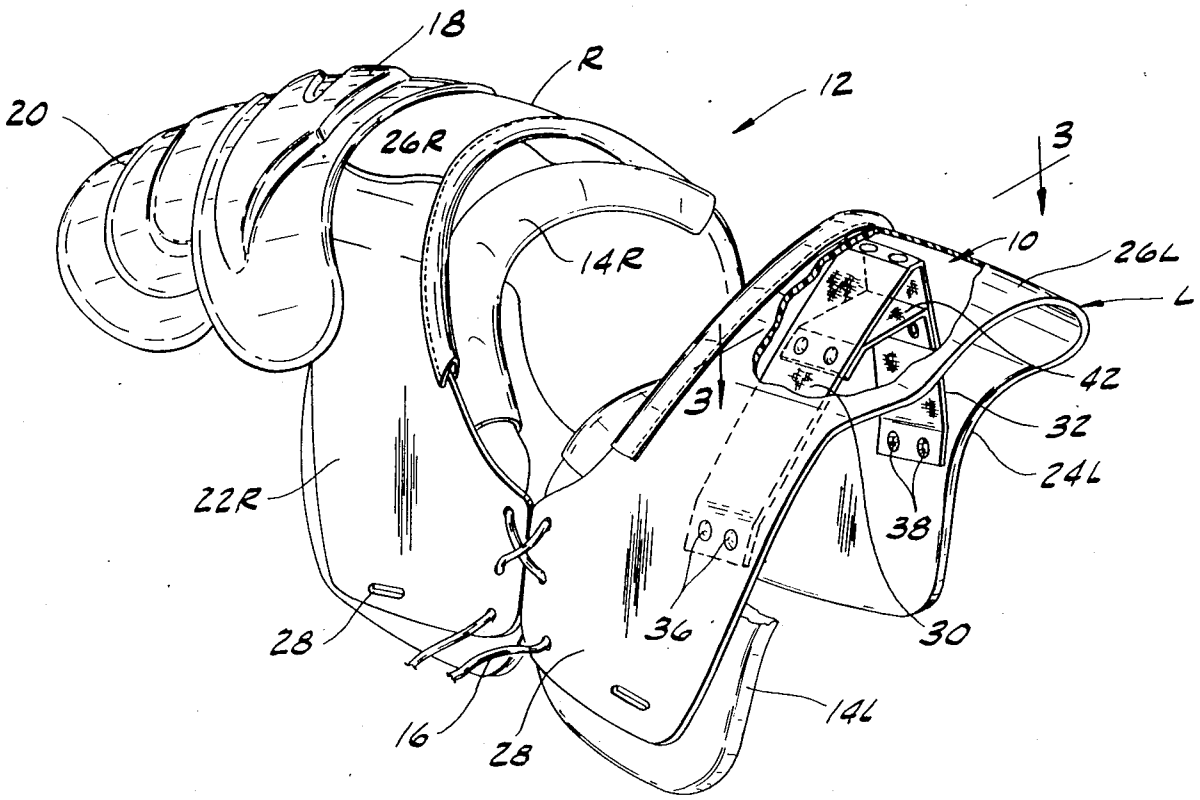
FIG. 1 is a perspective view, partially broken away, of a shoulder pad having a truss arch system of the present invention.

Now referring to the drawings, a shoulder pad truss arch system of the present invention is designated in its entirety by the reference numeral 10, and is particularly adapted for use in a shoulder pad 12 for football players and the like. As shown in FIG. 1, shoulder pad 12 comprises a left-hand arch member generally designated L and a right-hand arch member generally designated R. Left-hand arch member L is adapted to fit over the left shoulder of a football player, etc., and right-hand arch member R is adapted to fit over the right shoulder. For example, left-hand arch member L and right-hand arch member R have inner padding sections 14L and 14R, respectively, which along with the right-hand and left-hand arch members have a generally inverted U-shape as viewed from the side (see FIG. 3). Truss arch system 10 is disposed between arch member L and inner padding section 14L. Means are provided for attaching the right-hand and left-hand arch members L and R together, such as laces 16 or rivets (not shown). The shoulder pad may be provided with conventional upper epaulets 18 and outer epaulets 20 (shown for the right-hand arch member in FIG. 1). Conventional side straps (not shown) may also be provided for securing the shoulder pads to the shoulders of the football player.

Figure 2:
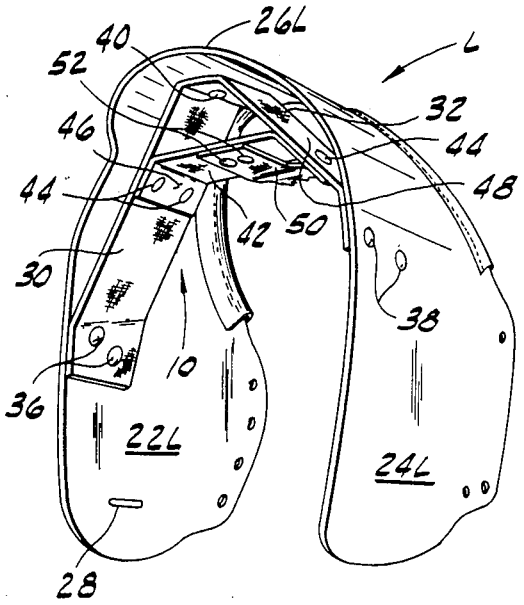
FIG. 2 is a perspective view of an arch member for the shoulder pad of FIG. 1.
Figure 3:
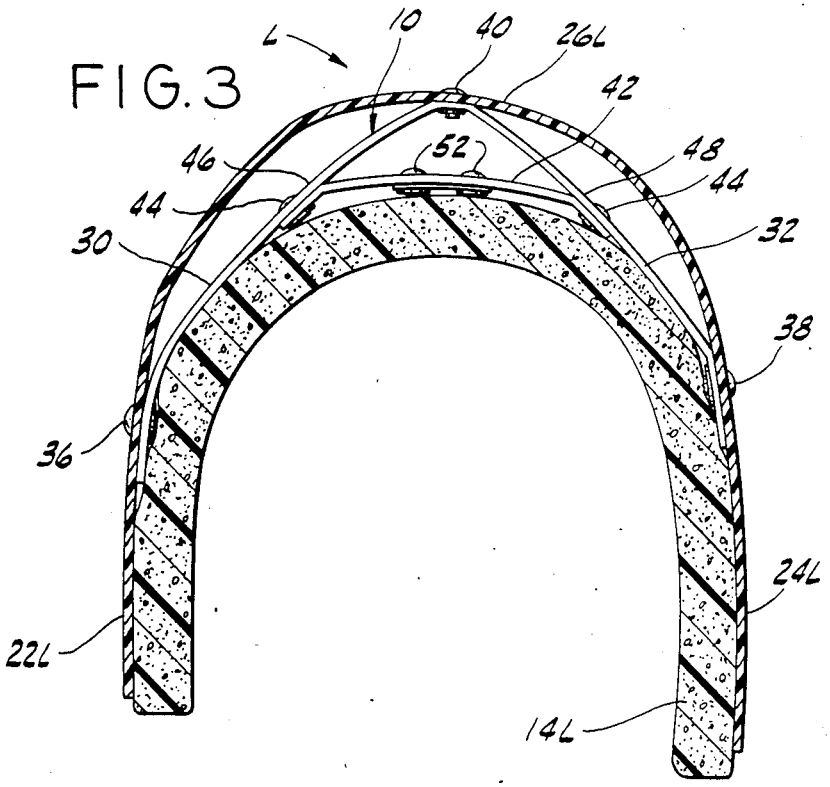
FIG. 3 is a cross-sectional view along line 3—3 of FIG. 1.

As shown in FIGS. 1 through 3, left-hand arch member L includes a chestplate portion 22L and a backplate portion 24L, which are interconnected by a curved shoulder portion 26L, and right-hand arch member R includes a chestplate portion 22R and backplate portion (not shown), which are interconnected by a curved shoulder portion 26R. The arch members may, but need not, be of integral construction, as shown in the drawings. The chestplate and backplate portions are provided with means, such as slots 28, for attaching the side straps (not shown).

Left-hand member L is hereinafter used to illustrate various aspects of the invention. It is understood, though, that the following discussion applies to both the right-hand and left-hand members, with the right-hand member being a mirror image of the left-hand member.

Preferably, truss arch system 10 comprises a first (forward) truss 30 extending from chestplate portion 22L to shoulder portion 26L, and a second (rearward) truss 32 extending from backplate portion 24L to shoulder portion 26L, as shown in FIGS. 2 and 3. Means are provided for attaching the trusses to arch member L. For example, first truss 30 may be riveted (at 36) to chestplate portion 22L, and second truss 32 may be riveted (at 38) to backplate portion 24L. Both truss members are then riveted (at 40) to shoulder portion 26L.

A truss bridge 42 is provided to the truss arch system 10. Truss bridge 42 has one end attached (e.g., by rivets 44 or by stitching (not shown)) to a mid-portion 46 of first truss 30 and the other end attached (e.g., by rivets 44) to a mid portion 48 of second truss 32, so that the truss bridge is roughly parallel to a plane tangent to shoulder portion 26L, and thus truss bridge 42 suspends the truss system and the shoulder pad on the shoulder of the wearer. Truss bridge 42 may be thought of as forming the base of an isoceles triangle with the first and second trusses 30 and 32 forming the sides thereof, as illustrated in FIG. 3. A conventional web hinge 50 for outer epaulet 20 may be attached to truss bridge 42 (e.g., by rivets 52).

First truss 30, second truss 32, and truss bridge 42 may be of flexible material, such as a synthetic woven material, and are preferably of substantially equal width, as shown in FIGS. 1 and 2. For example, first and second trusses 30 and 32 may be different portions of one flexible strap as they are shown in the preferred emodiment.

Figure 4:
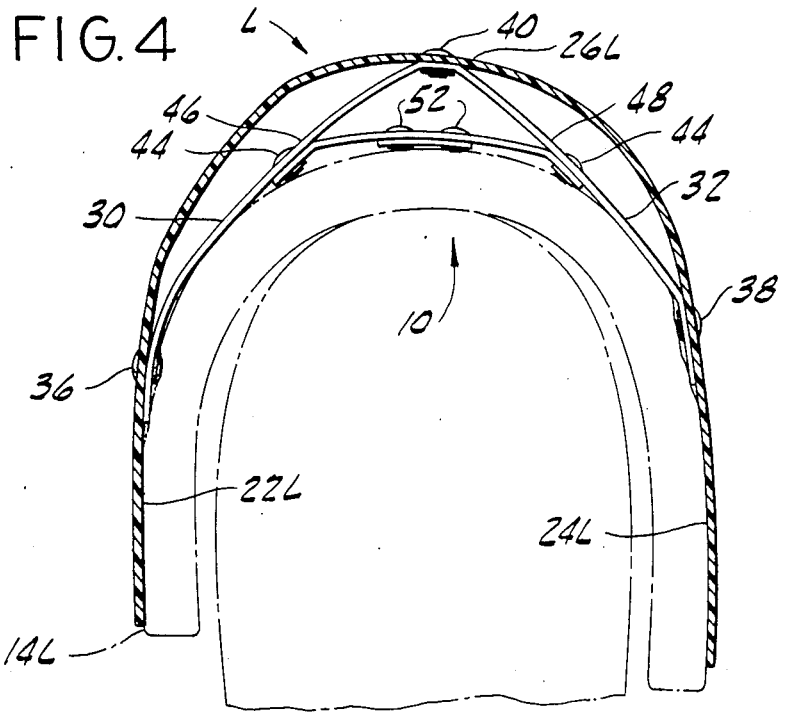
FIG. 4 is a cross-sectional view similar to FIG. 3, showing the truss system when the shoulder pad is not impacted.
Figure 5:
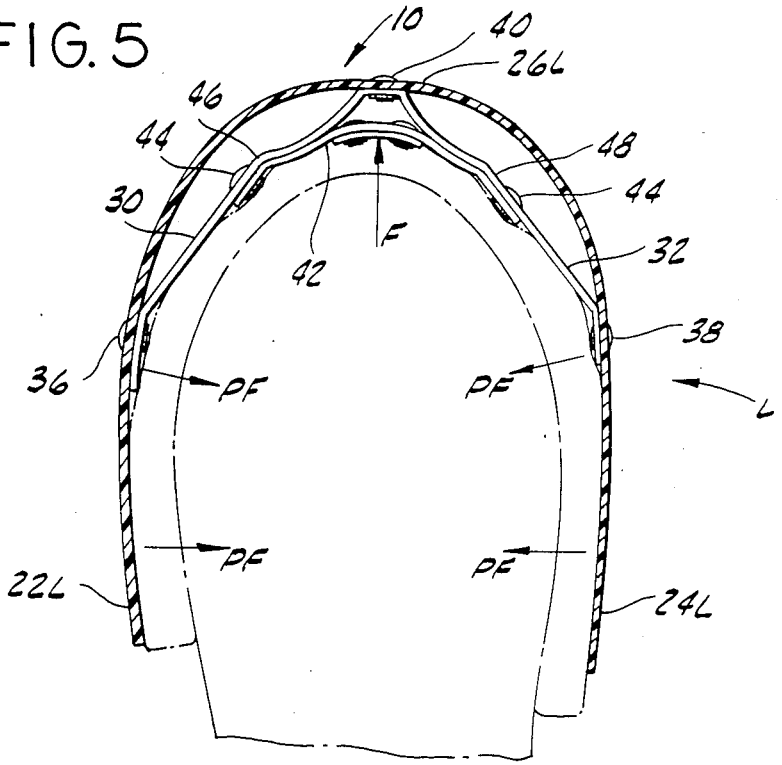
FIG. 5 is a cross-sectional view similar to FIG. 4, illustrating how the truss system and shoulder pad respond to impact.

As illustrated in FIG. 5, when shoulder pad 12 is impacted, upward motion of the shoulder relative to the shoulder pad is caused by the combination of the impact force (not shown) and a reaction force F exerted on truss bridge 42 by the shoulder of a wearer. The relative upward motion of truss bridge 42 causes first and second trusses 30, 32 to be in tension, thereby pulling chestplate and backplate portions 22L and 24L toward one another. As a result, horizontal pinching forces PF are exerted on the shoulder (shown in phantom) of the wearer, and the original impact force is spread over the inner padding sections instead of concentrated on the top thereof. (This can best be seen by comparing the admittedly exaggerated illustration of the shoulder pad when not impacted in FIG. 4 with the illustration of the shoulder pad during impact in FIG. 5.) As the original impact force increases, this reaction increases, and thus larger impact forces are more thoroughly spread over the shoulder of a wearer than smaller forces.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoulder pad truss arch system for a shoulder pad having a arch member adapted to fit over a shoulder of a wearer, the arch member being of generally inverted U-shape as viewed from the side and having chestplate and backplate portions interconnected by a curved shoulder portion, the shoulder pad truss arch system comprising a first truss extending up from the chestplate portion of the arch member to the shoulder portion of the arch member, a second truss extending up from the backplate portion of the arch member to the shoulder portion of the arch member, and a truss bridge extending between the first and second trusses at a location spaced below the shoulder portion of the arch member, said truss bridge having one end attached to the first truss and the other end attached to the second truss so as to suspend the truss system and thus the shoulder pad on the shoulder of the wearer such that impact on the shoulder portion of the arch member causes the shoulder of the wearer to force at least a portion of the truss arch system generally upwardly to pull the chestplate and backplate portions toward one another.

2. A shoulder pad truss arch system as set forth in claim 1 wherein the first and second trusses comprise at least one flexible strap.

3. A shoulder pad truss arch system as set forth in claim 2 wherein the trusses and truss bridge are of a synthetic woven material.

4. A shoulder pad truss arch system as set forth in claim 2 wherein the truss bridge is of flexible material, the truss bridge being secured to the first and second trusses at a mid-portion of each thereof.

5. A shoulder pad truss arch system as set forth in claim 1 includes means for attaching the first truss to the chestplate portion of the arch member and means for attaching the second truss to the backplate portion of the arch member.

6. A shoulder pad truss arch system as set forth in claim 1 wherein the width of the first truss, the width of the second truss and the width of the truss bridge are substantially equal to one another.

7. A shoulder pad truss arch system as set forth in claim 1 including a pad section adjacent and underlying the first truss, the second truss and the truss bridge.

8. A shoulder pad truss arch system as set forth in claim 1 wherein the truss bridge member forms the base of an isoceles triangle, the first truss and the second truss forming the sides of the isoceles triangle.

9. A shoulder pad truss arch system as set forth in claim 1 wherein the truss bridge is roughly parallel to a plane tangent to the shoulder portion of the arch and secured to a mid-portion of the first and second trusses.

10. A shoulder pad truss arch system as set forth in claim 1 wherein said first and second trusses are secured to the shoulder portion of said arch member.

11. A shoulder pad truss arch system as set forth in claim 10 wherein said first and second trusses are intergrally formed and secured to the shoulder portion of the arch member at the juncture of the trusses.

12. A shoulder pad truss arch system as set forth in claim 11 wherein said first and second trusses and said truss bridge form a generally A-shaped structure.

13. A shoulder pad truss arch system as set forth in claim 12 wherein said truss bridge is secured to the first and second trusses at a mid-portion of each thereof.

14. A shoulder pad truss arch system as set forth in claim 1 wherein said first and second trusses and said truss bridge form a generally A-shaped structure.

* * * * *